US010803701B2

(12) United States Patent
Tran

(10) Patent No.: US 10,803,701 B2
(45) **Date of Patent: *Oct. 13, 2020**

(54) ELECTRONIC GAMING MACHINE

(71) Applicant: Aristocrat Technologies Australia Pty Limited, North Ryde, NSW (AU)

(72) Inventor: Dinh Toan Tran, Wetherill Park (AU)

(73) Assignee: Aristocrat Technologies Australia PTY Limited (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/406,751

(22) Filed: May 8, 2019

(65) Prior Publication Data

US 2019/0266834 A1 Aug. 29, 2019

Related U.S. Application Data

(63) Continuation of application No. 16/178,308, filed on Nov. 1, 2018, now Pat. No. 10,332,337, which is a (Continued)

(30) Foreign Application Priority Data

Aug. 8, 2016 (AU) ..... 2016903109

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3258* (2013.01); (Continued)

(58) Field of Classification Search
USPC ..... 463/20
See application file for complete search history.

(56) References Cited

U.S. PATENT DOCUMENTS

2008/0113771 A1* 5/2008 Baerlocher ..... G07F 17/32 463/25
2013/0225278 A1* 8/2013 Kniesteadt ..... G07F 17/3283 463/27

(Continued)

OTHER PUBLICATIONS

Examination Report No. 1 for standard patent application issued from the Australian Government IP for Application No. 2019200782 dated Apr. 24, 2020, pp. 1-5.

*Primary Examiner* — Pierre E Elisca
(74) *Attorney, Agent, or Firm* — McAndrews, Held & Malloy, Ltd.

(57) ABSTRACT

An electronic gaming machine comprising a display, a memory storing program instructions for each of a plurality of different games, a game controller for executing the program instructions, the game controller configured to conduct plural game instances in respective ones of a plurality of game areas on the display based on one or more player selections from among the different games, the game controller configured to operate in a first mode when conducting less than a defined number of game instances and a second mode when conducting a defined number of game instances, wherein when operating in the second mode, the game controller is configured to add at least one additional game feature to each of the defined game instances irrespective of the player game selections of games for the respective game areas.

20 Claims, 11 Drawing Sheets

Related U.S. Application Data continuation of application No. 15/670,969, filed on Aug. 7, 2017, now Pat. No. 10,134,222.

(52) U.S. Cl.
CPC ..... *G07F 17/3265* (2013.01); *G07F 17/3267* (2013.01); *G07F 17/34* (2013.01)

(56) References Cited

U.S. PATENT DOCUMENTS

| | | | | |
|---|---|---|---|---|
| 2014/0094298 | A1 | 4/2014 | Lyons et al. | |
| 2015/0213683 | A1* | 7/2015 | Graham | G07F 17/3225 463/25 |
| 2016/0203675 | A1* | 7/2016 | Lutnick | G07F 17/3225 463/16 |
| 2017/0249806 | A1* | 8/2017 | Lutnick | G07F 17/3244 |

* cited by examiner

ELECTRONIC GAMING MACHINE

RELATED APPLICATIONS

The present application is a continuation of U.S. patent application Ser. No. 16/178,308, filed Nov. 1, 2018, which is a continuation of U.S. patent application Ser. No. 15/670,969, filed Aug. 7, 2017, now U.S. Pat. No. 10,134,222, issued Nov. 20, 2018, which claims priority to Australia Provisional Patent Application No. 2016903109, having a filing date of Aug. 8, 2016. Each of the above-mentioned applications are hereby incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Gaming machines have been proposed which allow a player to play multiple games at the same time. To date such gaming machines have little functionality which enables interaction between the multiple games, facilitates selection of multiple games, confers additional benefits for playing multiple games, or which enables the conduct of alternate game play in dependence on the number of games played.

A need exists for alternative gaming machines.

BRIEF SUMMARY OF THE INVENTION

In a first aspect, the invention provides an electronic gaming machine comprising:

a display;

a memory storing program instructions for each of a plurality of different games;

a game controller for executing the program instructions, the game controller configured to conduct plural game instances in respective ones of a plurality of game areas on the display based on one or more player selections from among the different games, the game controller configured to operate in a first mode when conducting less than a defined number of game instances and a second mode when conducting a defined number of game instances, wherein when operating in the second mode, the game controller is configured to add at least one additional game feature to each of the defined game instances irrespective of the player game selections of games for the respective game areas.

In an embodiment, the at least one additional game feature enables additional game play to be triggered in each of the game instances.

In an embodiment, at least one additional game feature enables an additional prize to be won during play of the game.

In an embodiment, each of the different games are spinning reel games and the at least one additional game feature modifies at least one reel of each of the game instances to incorporate at least one additional function symbol during play of the respective game instance.

In an embodiment, the at least one additional game feature modifies at least one reel by replacing the at least one reel with a reel composed of function symbols.

In an embodiment, the function symbol is a substitute symbol.

In an embodiment, the game controller is configured to operate in the second mode when conducting more than the defined number of game instances.

In an embodiment, the defined number is the maximum number of game instances.

In a second aspect, the invention provides a method of operating a gaming machine comprising a display, a memory storing program instructions for each of a plurality of different games, and a game controller for executing the program instructions, the method comprising the game controller:

conducting one or more game instances in respective ones of a plurality of game areas on the display based on one or more player selections from among the different games, including by conducting plural game instances when more than one game instance is conducted;

operating in a first mode when conducting less than a defined number of game instances; and operating in a second mode when conducting a defined number of game instances, wherein operating in the second mode, comprises the game controller adding at least one additional game feature to each of the defined game instances irrespective of the player game selections of games for the respective game areas.

In a third aspect, the invention provides an electronic gaming machine comprising:

a display;

a memory storing program instructions for each of a plurality of different games;

a game controller for executing the program instructions, the game controller configured to:

conduct plural game instances in respective ones of a plurality of game areas on the display based on one or more player selections from among the different games, maintain a common jackpot prize winnable from any one of the game instances during a play of a respective game instance, monitor concurrent plays of each of the game instances for a jackpot award condition to be met, and upon one or more jackpot prize award conditions being met in respect of one or more of concurrent plays of the game instances, make an award of the common jackpot prize in respect of each jackpot condition that is met.

In an embodiment, the game controller maintains a plurality of jackpot prizes each having an associated jackpot award condition.

In a fourth aspect, the invention provides a method of operating an electronic gaming machine comprising a display, a memory storing program instructions for each of a plurality of different games, and a game controller for executing the program instructions, the method comprising the game controller:

conducting plural game instances in respective ones of a plurality of game areas on the display based on one or more player selections from among the different games, maintaining a common jackpot prize winnable from any one of the game instances during a play of a respective game instance, monitoring concurrent plays of each of the game instances for a jackpot award condition to be met, and upon one or more jackpot prize award conditions being met in respect of one or more of concurrent plays of the game instances, making an award of the common jackpot prize in respect of each jackpot condition that is met.

In a fifth aspect, the invention provides an electronic gaming machine comprising:

a display;

a memory storing program instructions for each of a plurality of different spinning reel games;

a game controller for executing the program instructions, the game controller configured to conduct plural game instances in respective ones of a plurality of game areas on the display based on one or more player selections from among the different spinning reel games, the game controller configured to respond to a trigger condition being met by modifying at least one reel of each of the game instances to incorporate at least one additional symbol during play of the respective game instance.

In an embodiment, the game controller modifies at least one reel by replacing the at least one reel with a reel composed of function symbols.

In an embodiment, the function symbol is a substitute symbol.

In an embodiment, the game controller is configured to modify the at least one reel of each of the game instances by adding a symbol to one or more reserved reel positions of each reel.

In an embodiment, there are a plurality of contiguous reserved reel positions.

In an embodiment, the added symbol is selected by the game controller.

In a sixth aspect, the invention provides a method of operating an electronic gaming machine comprising a display, a memory storing program instructions for each of a plurality of different spinning reel games, and a game controller for executing the program instructions, the method comprising the game controller:

conducting plural game instances in respective ones of a plurality of game areas on the display based on one or more player selections from among the different spinning reel games, and responding to a trigger condition being met by modifying at least one reel of each of the game instances to incorporate at least one additional symbol during play of the respective game instance.

In a seventh aspect, the invention provides an electronic gaming machine comprising:

a touch screen display;

a memory storing program instructions for each of a plurality of different games;

a game controller for executing the program instructions, the game controller configured to:

control the display to display a game selections interface comprising a plurality of game areas and a plurality of game icons corresponding to respective ones of the plurality different games;

monitor the touch screen for touch gestures in respect of the game icons and in response to determining a touch gesture beginning at a respective game icon and directed towards a respective game area, populating the game area with a game instance of the game corresponding to the respective game icon.

In an embodiment, the touch gesture is a drag gesture.

In an embodiment, the touch gesture is a flick gesture.

In an eighth aspect, the invention provides computer program code which when executed implements the above method.

In a ninth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
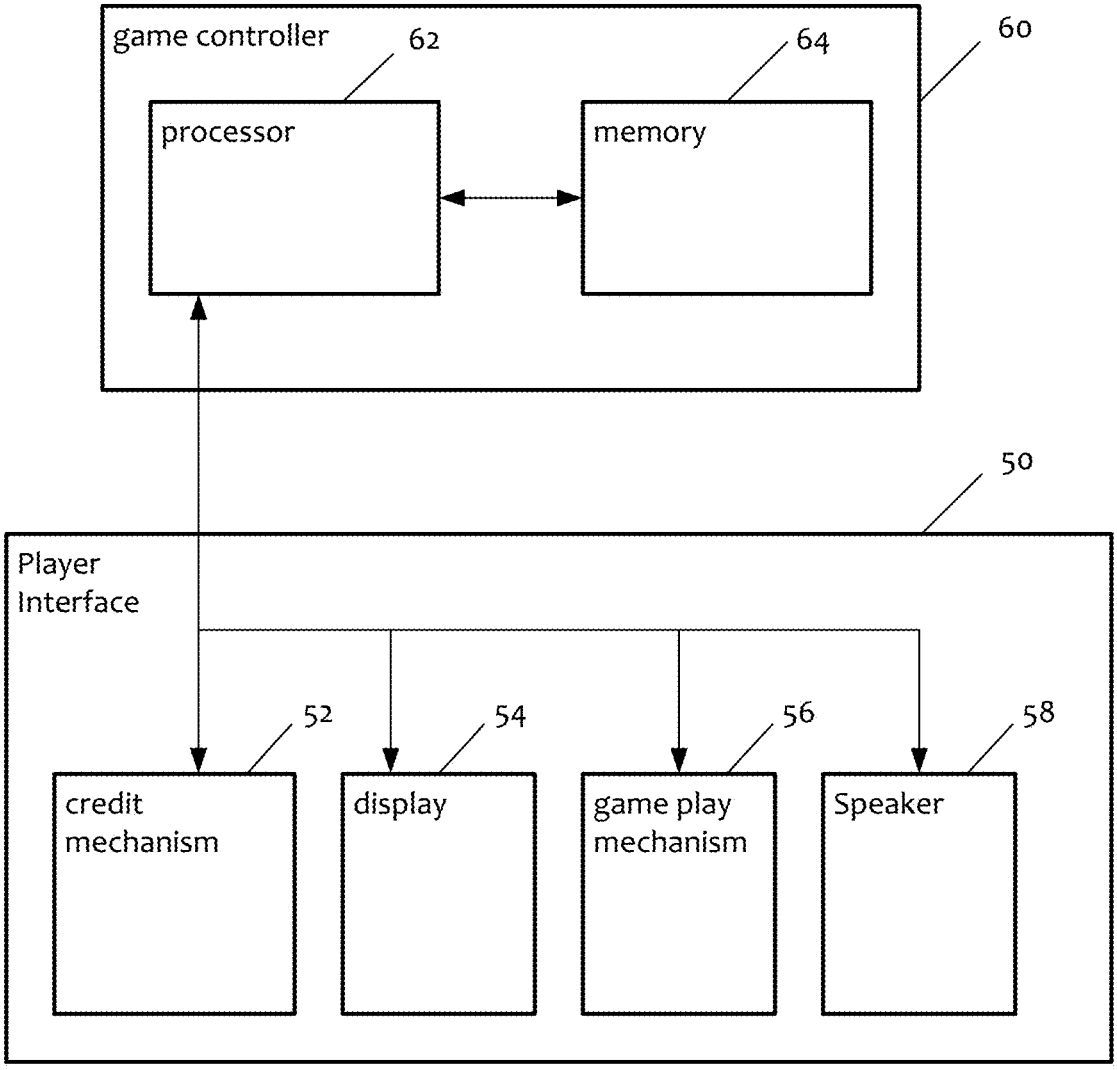
FIG. 1 is a block diagram of the core components of a gaming machine.

Referring to the drawings, there is shown a gaming machine that has an improved interface for selecting which of a plurality of different games will be played on the gaming machine. The gaming machine also has functionality for operating in different modes depending on the number of game instances being played and which adds elements of additional game play in a mode.

General Construction of Gaming Machine

The gaming machine can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming machine has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game selection and game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
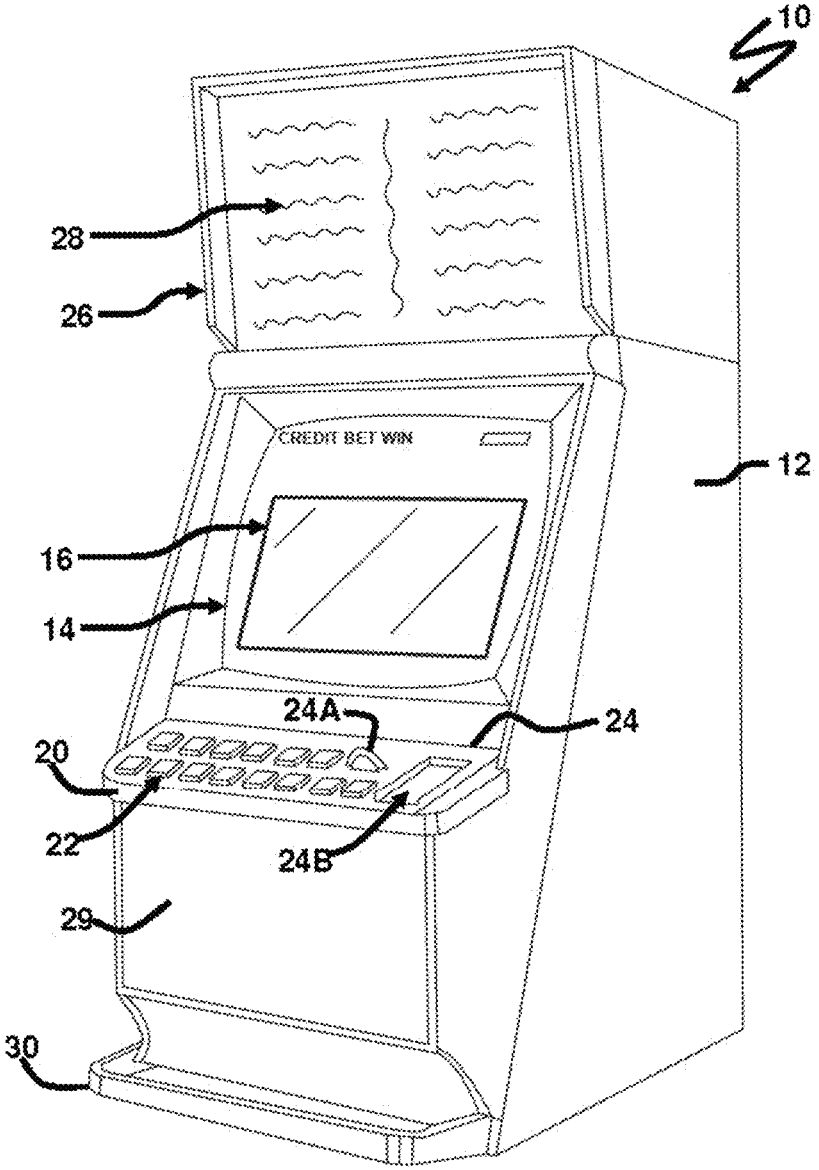
FIG. 2 is a perspective view of a stand alone gaming machine.

A standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module that is accessed in response to insertion of the player tracking device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a liquid crystal display. The display 14 may any other suitable video display unit, such as an OLED display. The top box 26 may also include a display, which may be of the same type as the display 14, or of a different type.

Figure 3:
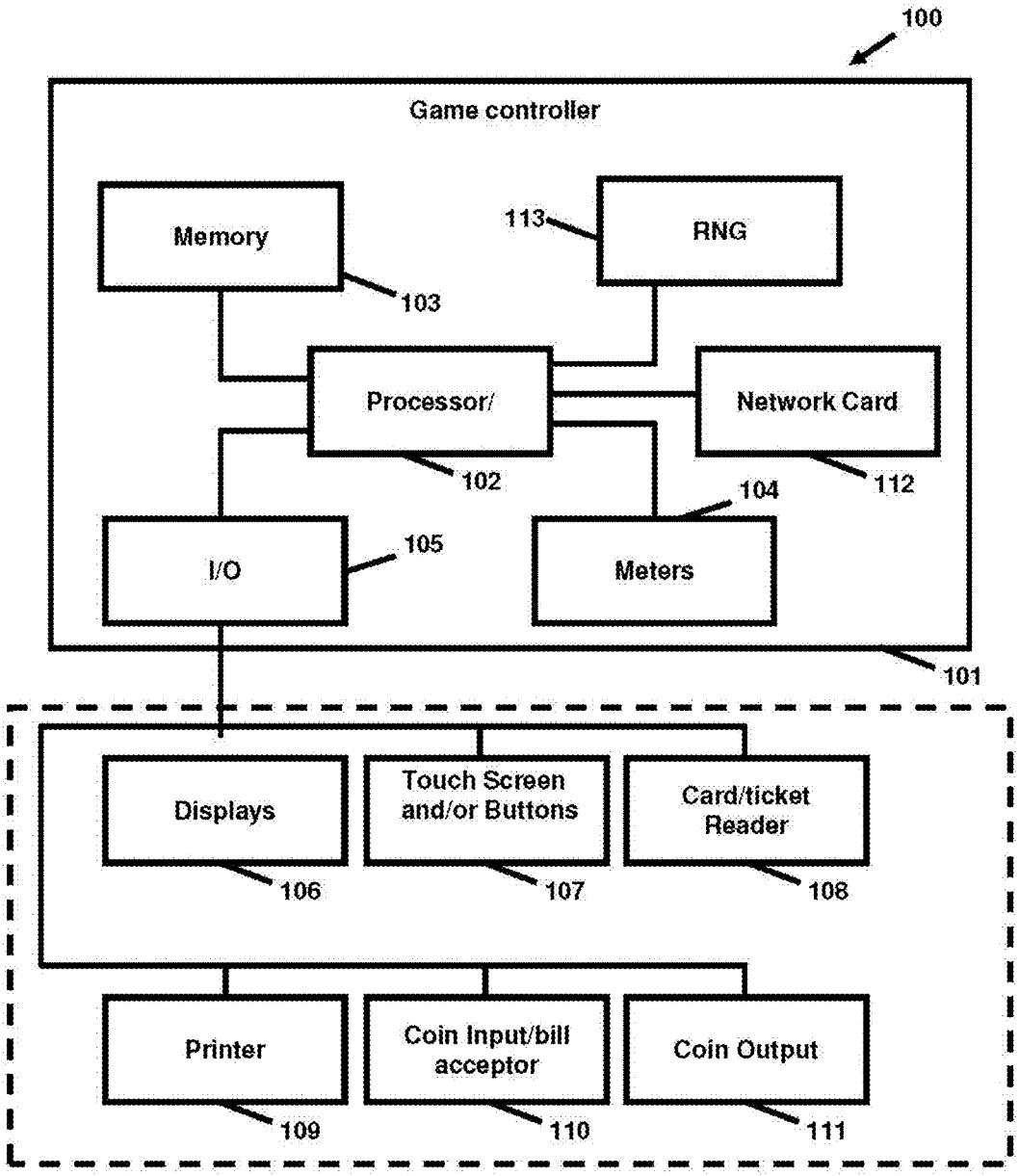
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed. A touch screen can also monitor for other gestures, e.g. a drag gesture.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
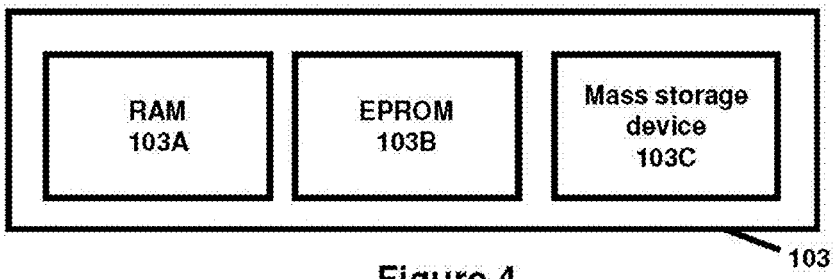
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
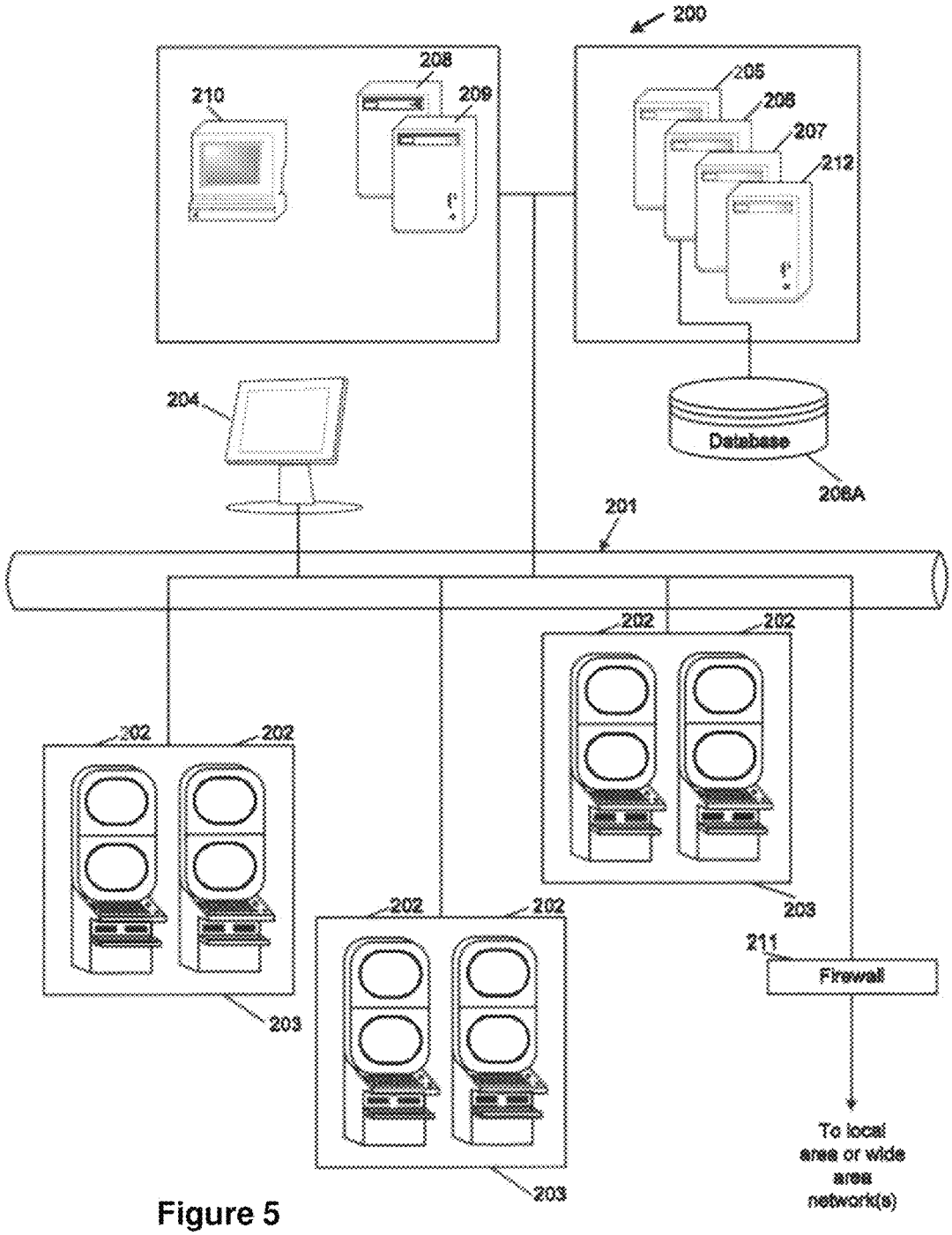
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

Figure 6:
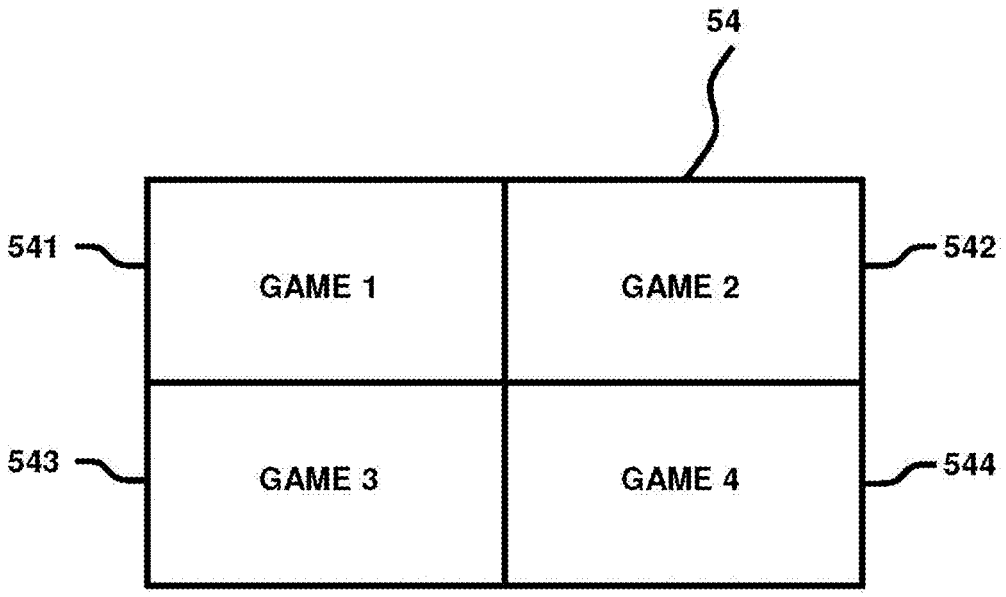
FIG. 6 is a schematic diagram of a display of multiple game areas.

Referring to FIG. 6, there is shown a schematic diagram of a display 54 having a first game display area 541 for a first game, a second game display are 542 for a second game, a third game display area 543 for a third game, and a fourth game display area 544 for a fourth game. The game play mechanism enables the player to select to play game 1 on its own, games 1 and 2, games 1, 2 and 3, and games 1-4. In the embodiment, the number of play lines for each of the games is fixed. That is, for each game, the player receives a fixed number of win lines for a base wager (e.g. 40 or 50 lines). The player can elect to play a multiple of the base wager, for example, 2, 5, or 10 times the base wager. Thus, the total quantum of a player's wager is dependent on the number of games played, the base wager cost, and the multiplier.

In other embodiments, the may select how many lines they play in each game—e.g. a minimum of one line up to the maximum number of lines allowed by the game (noting that not all permutations of win lines may be available for selection) and an amount per line—e.g. one, two or five credits. Winning outcomes on an activated win line may be evaluated based on a pay table that specifies the amount awarded for a one credit per line wager multiplied by the amount wagered per line.

Such win lines are typically formed by a combination of symbol display positions, one from each reel, the symbol display positions being located relative to one another such that they form a line.

In many games, the gaming machine may award winning outcomes which are not strictly limited to the lines they have selected, for example, "scatter" pays are awarded independently of a player's selection of pay lines.

Persons skilled in the art, will appreciate that in other embodiments, the player may selecting a number of reels to play. Games of this type are marketed under the trade name "Reel Power" by Aristocrat Leisure Industries Pty Ltd and are also known as "ways" to win games. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the center row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

In the embodiment described below, the display positions are arranged in a rectangular matrix comprising a five columns (corresponding to five reels) and four rows. However, other arrangements are known in the gaming industry and could be employed in embodiments of the invention. For example, in some arrangements there are more symbols in some columns than others, such as 3-4-3-4-3 arrangement of seventeen display positions corresponding to respective ones of five reels. In such arrangements, the columns of four symbols can be arranged so that they are off-set or staggered relative to the columns having three symbols so that the middle two symbols in the columns of four symbols share boundaries with two symbols of each neighboring reel.

Figure 7:
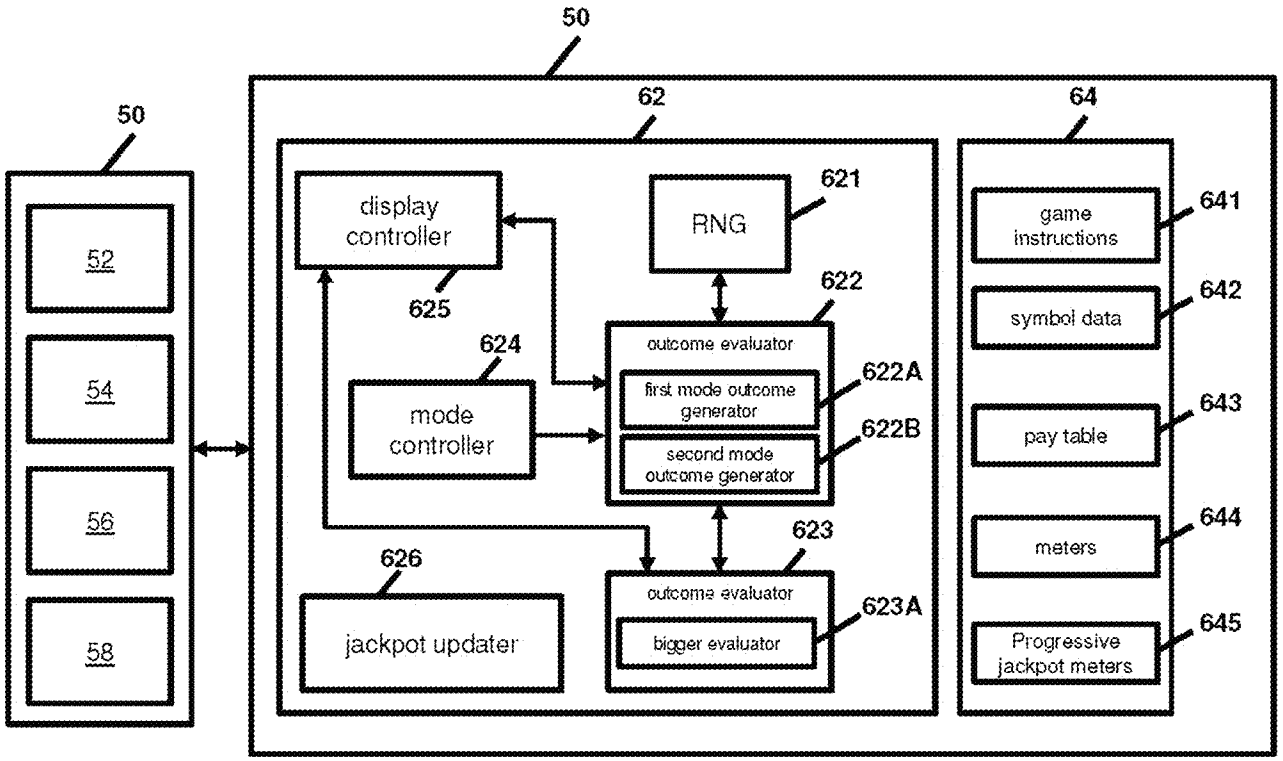
FIG. 7 is a further block diagram of a gaming machine.

Referring to FIG. 7, there is shown a gaming machine 1 of an embodiment in the invention. The processor 62 of game controller 60 of gaming machine 1 is shown implementing a number of modules based on program code and data stored in memory 64. Persons skilled in the art will appreciate that various of the modules could be implemented in some other way, for example by a dedicated circuit. As indicated above, the player is required to make a selection of a number of games to play. The mode controller 624 determines a mode to be implemented by the outcome generator 622 in accordance with the selected number of games. In the embodiment, the games are selected from a plurality of different games which are stored as game instructions 641. In this example, four different games. The game mechanism 56 is arranged so that a player can select any combination of games to play within the game areas that the player has selected to play. For example, if the player has selected to play all four game areas, the player can select four different games, four of the same game, two of one game and two of another game, etc.

In the embodiment, the mode controller 624, causes the game controller to operate in a first mode by causing a first mode outcome generator 622A to operate if the player selects less than four games, and causes the game to operate in a second mode if the player selects all four games by causing the second mode outcome generator 622B to operate. It will be noted that in this embodiment, the defined number of games to activate a second mode is the maximum number of games that are available. In other embodiments, the defined number of games can be less than the maximum number of games such that the second mode is activated by the mode controller 624 provided a player selects at least a defined number of games. That is, the mode controller will control the outcome generator 622 to operate in the second mode if either a defined number of games are played or more than the defined number of games are played.

The outcome generator 622 uses a random number generator 621 to generate game outcomes based on a symbol data 642. In embodiments of the invention, the symbol data corresponds to reel data for a plurality of spinning reel games.

One example of selecting symbols is for the outcome generator 622 to select symbols for display from a plurality of symbol sets defining reel strips 641 corresponding to respective ones of a plurality of spinning reels. The reel strips 641 specify a sequence of symbols for each reel. In an embodiment, the outcome generator 622 selects the symbols for display by selecting a stopping position in the sequence. In one example, four symbols of each of five reels are displayed such that symbols are displayed at twenty display positions on display 54. It is known to use a probability table stored in memory 64 to vary the odds of a particular stop position being selected. Other techniques can be used to control the odds of particular outcomes occurring to thereby control the return to player of the game.

The game controller also has an outcome evaluator 623 for evaluating generated outcomes based on a pay table 643. The outcome evaluator 623 also has a trigger evaluator 623A which determines whether the generated game outcomes will results in the triggering of one or more feature games.

Any awards made during play of the games added to the win meter and then can be transferred to the credit meter. The values of the win and credit meters are stored as meter data 644. The game outcomes and evaluations are displayed on display 54 under control of display controller 625. A jackpot updater 626 updates the values of the progressive jackpot 645 in memory 64. In the embodiment, there is at least jackpot prize that can only be awarded when all four games are played and this jackpot is only updated by jackpot updater when all four games are played.

Figure 8B:
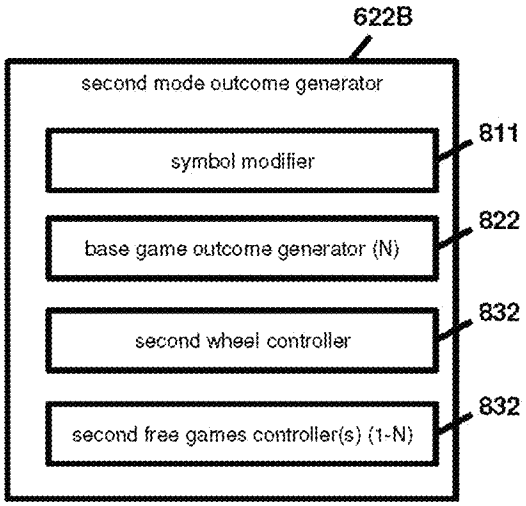
FIGS. 8A and 8B are block diagrams of first and second mode outcome generators.
Figure 8A:
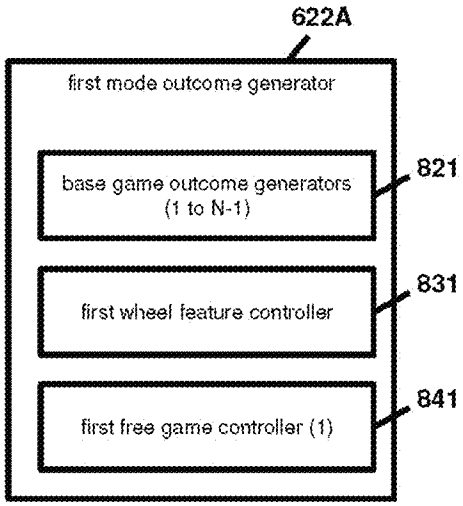

FIGS. 8A and 8B respectively show the first main outcome generator 622A and the second mode outcome generator 622B. The first mode outcome generator 622A includes a number of base game outcome generators 821. The number of base game outcome generators 821 that are instantiated depends on the player selection such that there are one to three outcome generators (or 1 to N−1 base game generators, where N is the defined number of game instances). Each of the base game outcome generators 821 operate independently to generate game outcomes by selecting symbols from reels for display in the corresponding game display area.

The base game is a part of the game which is carried out each time the player makes a wager, typically irrespective of the wager, whereas other parts of the game will only be carried out occasionally, for example, if a trigger condition is met.

An outcome of each of the games may be the award of the first wheel feature which is conducted under the control of a first wheel feature controller 831. The first wheel feature controller controls an animation of a spinning wheel having a number of segments. Each of the segments corresponds either to one of a plurality of jackpot prizes or to a number of free games being awarded in the game that caused the free wheel feature to be triggered. The award that is made depends on where the wheel spins, stops relative to an indicator which indicates which segment has been selected.

The first game outcome generator also includes a first free game controller which is instantiated based on game instructions of the relevant game to carry out the free games if free games are awarded.

Persons skilled in the art will appreciate that the wheel game and the free games are examples of feature games. A feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example, the wheel game described above or a game where the player makes selections in a "pick a box type" game.

The trigger event may be a symbol combination in the game such as a defined number of scatter symbols.

The second mode outcome generator 622B of the embodiment is configured so that the game controller 60 add three additional features of game play in response to the defined number of game instances being selected. Exemplary added features may include:

1) functionality which enables at least one symbol to be modified of at least one reel of each of the game instances;
2) a modified wheel game implemented by the second wheel controller 832 which enables the award of:
   a) an additional prize in the form of a super-jackpot prize that can only be won if all four games are played; and
   b) an award of free games conducted in each of the game instances.

To this end, the second mode outcome generator includes a symbol modifier 811 which conducts a random determination using random number generator 621 to determine whether to modify the reels of each game by adding 1, 2 or 3 wheels composed solely of a function symbol in the form of a wild symbol which acts to substitute for all other symbols. For example, different ranges of values that can be returned by the RNG 621, are allocated to no modification and adding 1, 2 or 3 wheels. In an example, each of the games has 5 reels and the wild reels can be added to reel 5, 4, or 3. In an example, up to three wild reels can be added.

In the embodiments, the modification is one which is independent of which game is being played in a specific game area. That is, the same modification in terms of using a wild symbol is applied in each area. (The visual presentation of that wild symbol will be specific to the theme of the game.) It will be apparent to persons skilled in the art that other function symbols could also be used, for example multiplier symbols or symbols which function as both a substitute and a multiplier symbol. Referring again to the second mode outcome generator 622B, it will be apparent that it will instantiate four base game outcome generators 822.

The second wheel controller 832 is modified to have different awards in the segments. It could also be modified to additional segments corresponding to additional awards. Two additional awards are added:

1. an award of a super-jackpot which is not available on the first wheel, and
2. segments corresponding to awards of free games in respect of all of the game instances. These awards can be combined within a single segment in some embodiments.

Further, the number of second free game controllers 842 instantiated when an award of free games will depend on whether the wheel game awards a series of free games in one of the instances (e.g. the free game controller will either conduct free games of the game instance that triggered the free games for each of the game instances).

Referring again to FIG. 7, the outcome evaluator evaluates the outcomes of the base games, the wheel games and the free games based on pay table 643. Typically, a winning outcome will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

It will also be apparent that an outcome of the game can be to award a jackpot prize for a particular symbol combination occurring in any of the underlying base game instances conducted in a separate game area. In embodiments of the invention, awards are made for each winning occurrence even if multiple winning occurrences occur at the same time. In this respect, assuming that the progressive jackpots have a base prize to which the jackpot is initiated if a jackpot award has been made, the first such award of a prize will result in the award of current value of the relevant progressive jackpot and the second award of the same jackpot prize will award the base value.

Figure 9:
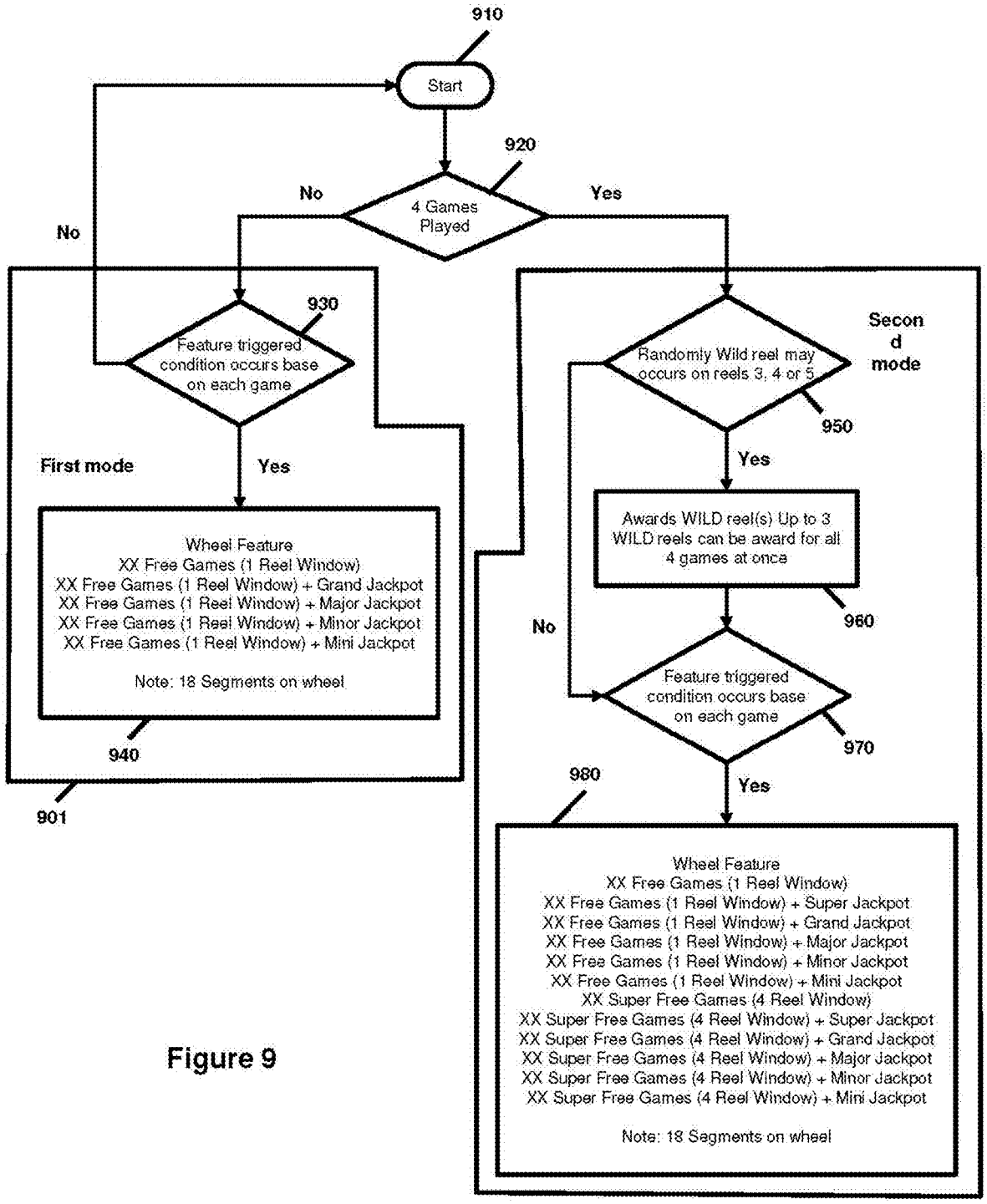
FIG. 9 is a flow chart of an embodiment.

Referred to FIG. 9, there is shown a flow chart of a method 900 of operating a gaming machine of an embodiment of the invention. As will be described in further detail below, the method involves the game controller operating in the first mode 901 or a second mode 902 dependent on whether or not less than four games or all four games are played. In this respect after the game starts 910, the method involves determining whether a defined number of game instances (here 4) are played. If not the game controller operates in a first mode 901 and it is determined whether a feature trigger condition occurs based on each game. The result is either if there is not an award of a feature game, the method returns to waiting for an initiation of a further play of the game. If there is the award of a feature game, the method involves the conduct of a wheel feature which can award one of: a defined number of free games in one reel window, a defined number of games plus a grand jackpot, a defined number of games plus a major jackpot, a defined number of games plus a minor jackpot or a defined number of free games plus a mini jackpot.

In contrast, if four games (the defined number) are played, then the game controller enters a second mode 902 in which randomly wild reel may be added to reels 3, 4 and/or 5 depending on the trigger conditions. If one or more wild reels are added, the wild reels are awarded for all four games at once 960. Irrespective of whether wild reels are added, it is determined whether a feature is triggered based on each game 970. If the feature is not triggered then the method returns to waiting for an initiation of a further play of the game. If a feature is triggered, the wheel feature 980 is conducted. In this case, the wheel feature has different segments including: a number of free games being conducted in one reel window, a number of free games being conducting in one reel window plus the award of a super jackpot, a number of games being awarded in one reel window plus a grand jackpot, a number of free games being awarded in one reel window plus a major jackpot, a number of free games being awarded in one reel window plus a minor jackpot, a number of free games being awarded in one reel window plus a mini jackpot. The wheel also includes segments corresponding to numbers of award of super free games, where free games are conducted in each of the reel windows (areas). These segments correspond to an award of free games alone or free games with any one of the super, grand, major, minor, and mini jackpots. In both wheel features, there are 16 segments on the wheel which contain various ones of the potential awards.

Figure 10:
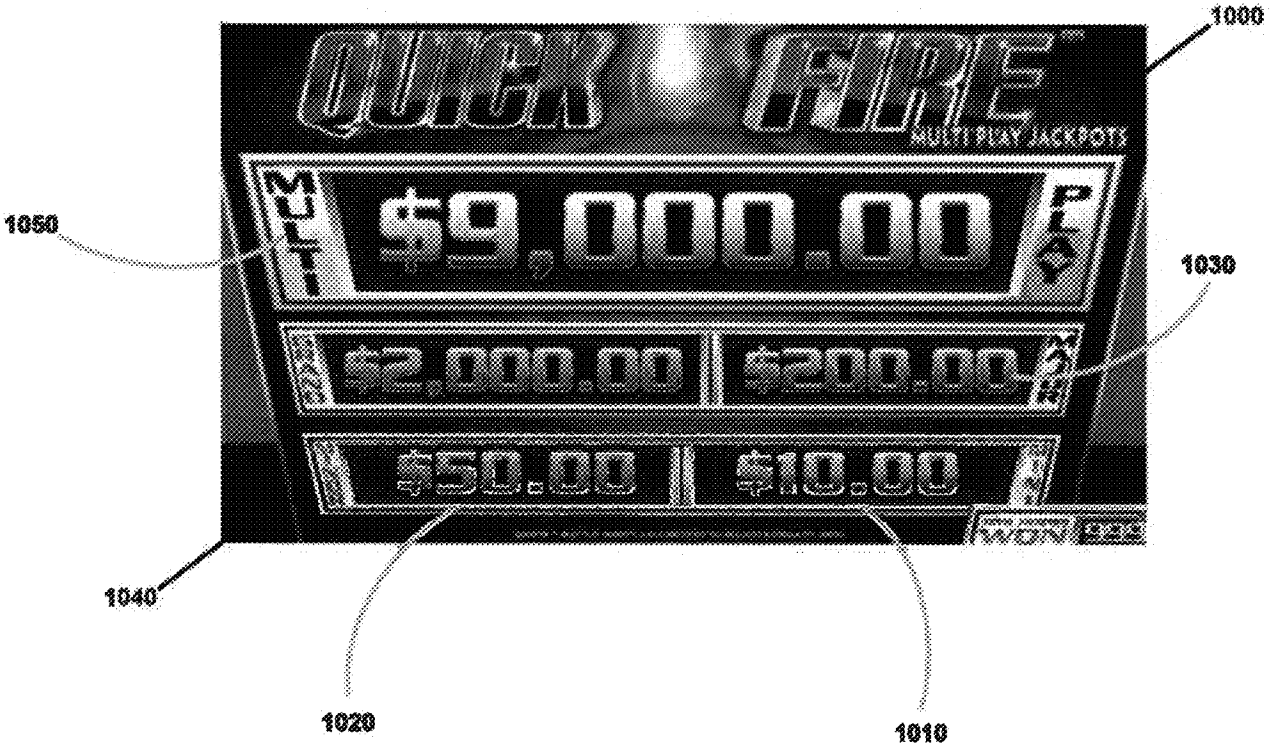
FIG. 10 is an exemplary screen shot of a jackpot meter display.

Referring to FIG. 10, there is shown an example of a screen display 1000 of the jackpot prizes. The screen display may be displayed on a top box of the gaming machine. The screen display 1000 has the current values for the mini jackpot 1010, minor jackpot 1020, major jackpot 1030, grand jackpot 1040, and super or "multi-play" jackpot 1050 which can only be awarded if the player plays all four game instances.

Figure 11:
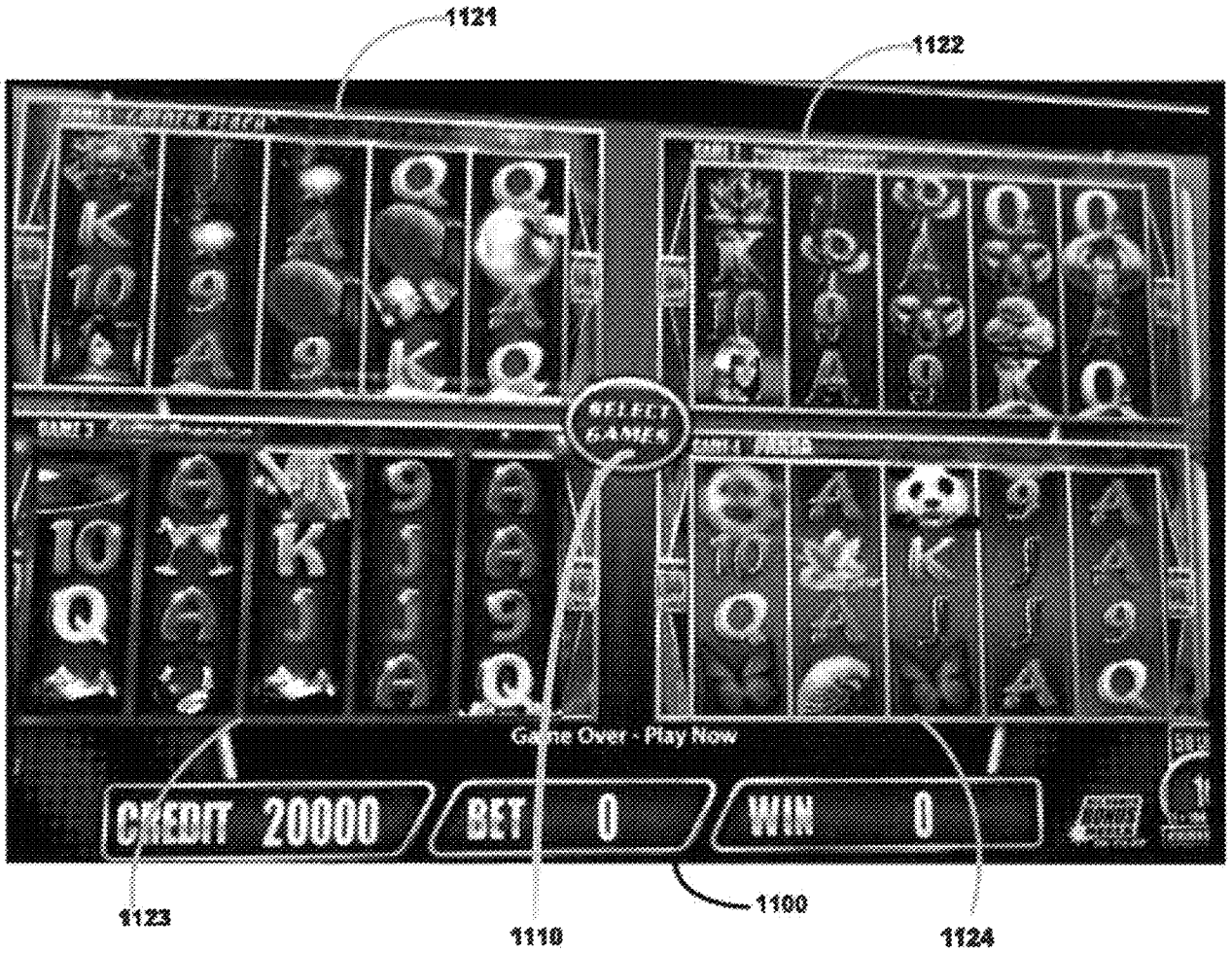
FIG. 11 is an exemplary screen shot of a game selection interface.
Figure 12:
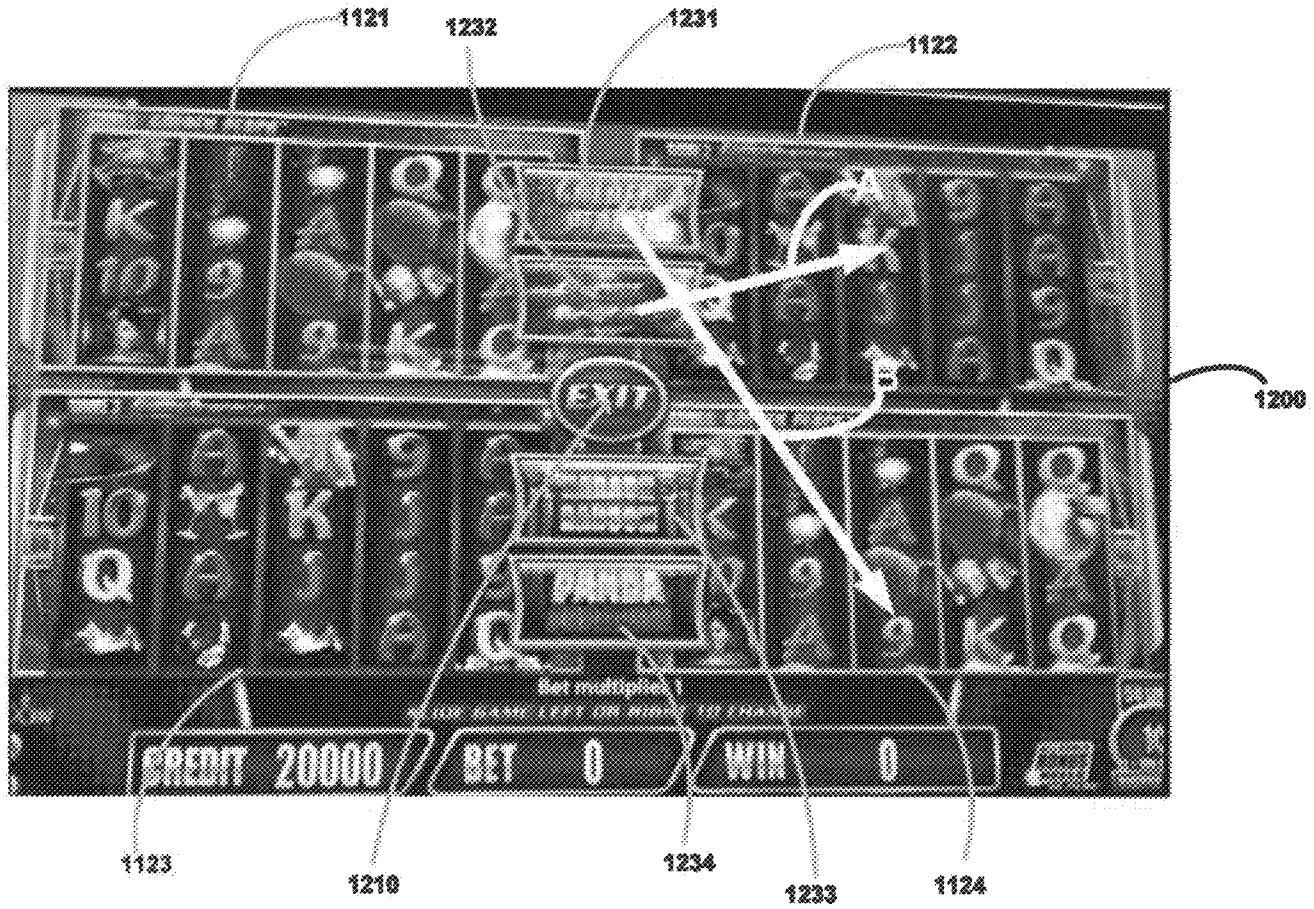
FIG. 12 is a further exemplary screen shot of a game selection interface.

FIGS. 11 and 12 illustrate an interface of an embodiment. The screen shot 1100 of FIG. 11 shows that a player has selected to play four game instances in game areas 1121, 1122, 1123, 1124. Shown in FIG. 11 are that the player has selected four different games: "Golden Peach" in area 1121, "Pharaoh's Ransom" in area 1122, "Electric Boogaloo" in area 1123, and "Panda Paradise" in area 1124. "Select Games" button 1110 is positioned in the middle of the display between the game areas 1121, 1122, 1123, 1124. The interface 1000 responds to the detection of a touch event on the button 1110 by changing the display to the game selection interface 1200 shown in the screen shot of FIG. 12. It will be apparent that four game icons 1231, 1232, 1233, 1234 have been added to the game selection interface and the "Select Games" button 1110 has been changed to an "Exit" button which if touched returns to the screen shown in FIG. 11.

The game icons 1231, 1232, 1233, 1234 correspond respectively to the four different games, that is the icon are "Golden Peach" icon 1231, "Electric Boogaloo" icon 1232, "Pharaoh's Ransom" icon 1233, and "Panda Paradise" icon 1234.

The game controller 60 is configured to monitor for touch event that start on respective ones of game icons 1231, 1232, 1233, 1234 and are directed towards respective ones of the game areas 1121, 1122, 1123, 1124. In the embodiment, the touch gesture is a drag gesture. In another embodiment, the touch gesture may be a flick gesture.

In the example, of FIG. 12 arrows A & B illustrate touch gestures that have been recognized by the game controller. Touch gesture A from Electric Boogaloo icon 1232 towards game area 1122 has cause the game displayed in area 1122 to change to Electric Boogaloo. Touch gesture B from Golden Peach icon 1231 towards game area 1124 has caused the game displayed in area 1124 to change to Golden Peach.

It is also possible for the player to slide each game left or right to change game.

Example

In one example, for each one of four games designated Game 1, Game 2, Game 3 and Game 4, the player can choose to play one of the titles listed below:

Golden Peach
Electric Boogaloo
Pharaoh's Ransom
Panda Paradise

Each game involves 5 reels with four symbols being displayed per reel. The player can chose between 40 lines or 50 Lines game. There is a forced minimum wager of 40 credits (cr) for 40 lines. There is a forced minimum of 50 cr for 50 lines. The player can also choose bet multiplier.

All four games can result in a win of a progressive jackpot prize as described below.

There are two different wheel features.

Wheel feature when 1-3 games played

Wheel feature when 4 games played.

When all 4 games are played a Random WILD REEL FEATURE is active in a bought game only (i.e. not in any awarded free games). At the start of any bought game, one or more reels may turn into Wild Reels. Only reels 3, 4 or 5 can become Wild reels. All symbols on Wild reels are replaced with the respective WILD symbol for each of the games played.

A Super Jackpot can be won in the wheel feature for four games. The super progressive meter only increment when 4 games are played.

The player can choose to play Game 1, Games 1-2, Games 1-3 or Games 1-4. All wins are multiplied by the bet multiplier except scatter. The scatter win is multiplied by total bet on each window.

To change game titles, the player touches <SELECT GAMES> 1110 and drags the titles to where the player wants them to be played.

The selection interface will also be revealed on coin in (after zero credit). The following Message will appear "SLIDE GAME LEFT OR RIGHT TO CHANGE". The player can frag and drop any game title to any one of the 4 windows to lock in the game in that window. Also, when a player moves a finger to the left or right, the next game will appear as if the player was rotating a cube having four sides with the respective games displayed on respective different faces. The player can touch <EXIT> to exit the menu or press the PLAY button to exit the menu and play on.

Each game has its own win messages displayed along the top of each game. The game controller is configured to dim unplayed games. The games are played When a player initiates a play of the game, the reels spin starting from left to right (Game 1 to Game 2) and top to bottom (Game 3 to Game 4).

When a WILD REEL FEATURE is triggered

All symbols on Wild reels are replaced with the respective WILD symbol for each of the games played during wild reel feature spins.

The Reels that change to WILD reel are the same for all 4 games played.

WILD REEL(S) award during reel spin. Reel spin only stop once WILD REELS animation is completed.

If the player receives a winning outcome, wins are displayed in the following order:

1. Super Jackpot wins (one at a time)
2. Grand Jackpot wins (one at a time)
3. Major Jackpot wins (one at a time)
4. Minor Jackpot wins (one at a time)
5. Mini Jackpot wins (one at a time)
6. Game 1 to Game 4
7. Line/scatter wins as normal When more than 1 feature is triggered at the same time, the gaming machine plays all the features in order of game position number.

In the Wheel Feature (when 1-3 games played), GRAND, MAJOR, MINOR and MINI progressives can be won. Plus free games feature.

In the Wheel Feature (when 4 games played) SUPER, GRAND, MAJOR, MINOR and MINI progressives can be won. Plus Free Games Feature or Super Free Games Feature.

The process flow of the wheel feature is as follows:

At the end of the spin, a banner is displayed on triggering games: "<GAME NAME> Wheel Feature!"

Screen transitions to the wheel with related to each game background (no player input)

A "SPIN" button is displayed on screen. Player can touch wheel or SPIN to start wheel spin Wheel spins to outcome. The selected Wheel segment is highlighted.

If a jackpot is won, jackpot animation celebration is played accompanying with sound.

The screen transitions to either Free Games Feature or Super Free Games Feature (when played 4 games).

Reels start spinning without additional player input.

Transitions back to base game. If more than one feature was triggered, the banner for the wheel feature which played is no longer there, and the next wheel feature is then played.

Super Free Games is played in all 4 game windows.

During free games feature and super free games feature, the game machine shows a relevant message line:

"Game X: Free Game x of y"

"Game X: Super Free Game x of y"

XX free games can be 10, 15, 25 for Golden Peach and Pharaohs Ransom (e.g. for different numbers of scatter symbols)

XX free games can be 7, 8, 9 for Electric Boogaloo and Panda Paradise

For 1-3 games played, the 16 wheel segments of the wheel game are:

GRAND JACKPOT XX FREE GAMES
XX FREE GAMES
XX FREE GAMES
XX FREE GAMES
MAJOR JACKPOT XX FREE GAMES
XX FREE GAMES
XX FREE GAMES
XX FREE GAMES
MINOR JACKPOT XX FREE GAMES
XX FREE GAMES
XX FREE GAMES
XX FREE GAMES
MINI JACKPOT XX FREE GAMES
XX FREE GAMES
XX FREE GAMES
XX FREE GAMES

For 4 games played, the 16 wheel segments of the wheel game are:

SUPER LEVEL JACKPOT XX SUPER FREE GAMES
MINI JACKPOT XX FREE GAMES
XX FREE GAMES
MINOR JACKPOT XX FREE GAMES
GRAND JACKPOT XX SUPER FREE GAMES
XX SUPER FREE GAMES
MAJOR JACKPOT XX FREE GAMES
XX FREE GAMES
SUPER LEVEL JACKPOT XX FREE GAMES
XX SUPER FREE GAMES
MINI JACKPOT XX SUPER FREE GAMES
XX FREE GAMES
GRAND JACKPOT XX FREE GAMES
MAJOR JACKPOT XX SUPER FREE GAMES
XX FREE GAMES
MINOR JACKPOT XX SUPER FREE GAMES

Base Game for Golden Peach

All wins left to right only except <SCATTER> symbols which pay any.

<WILD> symbol substitutes for all symbols except <SCATTER> and <QUICK FIRE> symbol.

<WILD> appears on reels 3, 4 and 5 only.

Jackpot is awardable on a lit line and via the Wheel Feature (Refer to jackpot section)

Free Games Feature

Only Minor & Mini Jackpots can be won in the free games.

All wins left to right only except <SCATTER> symbols which pay any.

<WILD> symbols substitutes for all symbols except <SCATTER> and <QUICK FIRE> symbols.

<WILD> appears on reels 2, 3, 4 and 5 only.

Stack symbols feature

Stacks of symbols appear on reels 2, 3 and 4 only.

At the start of each game one of the stacked reels is chosen randomly and those stacked symbols transform into <GOLD PEACH>.

The stacked symbols on the remaining stacked reels transform into one of the following: <GIRL>, <PEACOCK>, <LANTERN>, <SCROLL>, <FLOWER>, <A>, <K>, <Q>, <J>, <10> or <9> symbols.

Any 3 or more trigger the wheel feature.

Any 3, 4 or 5 <SCATTER> symbols award 10, 15 or 25 free games respectively on the wheel feature.

During free games feature, all wins pay as FEATURE PAYTABLE.

During the free games feature, any 3 or more <SCATTER> symbols award 5 free games.

Pharaoh's Ransom operates in the same manner but with different symbols.

Base Game for Electric Boogaloo

All wins left to right only.

<WILD> symbols substitute for all symbols except <SCATTER> and <QUICK FIRE> symbols.

<WILD> symbols appears on reels 3, 4 and 5 only.

Jackpot is awardable on lit line and from the Wheel Feature

Free Games Feature

All wins left to right only.

<WILD> symbols substitutes for all symbols.

<WILD> appears on reels 2, 3, 4 and 5 only.

A win of 3 or more scattered trigger the wheel feature.

A win of 3, 4 or 5 scattered <MIRRORBALL> awards 7, 8 or 9 free games respectively on the wheel feature.

If 4 <WILD> appear on the same reel during a free game they form a stack that stays on the reel for the remainder of the free games.

<WILD> appears on reels 2, 3, 4 and 5 only during the free games feature.

During free games feature, all wins pay as FEATURE PAYTABLE.

<SCATTER> does not appear during the feature.

Feature cannot be triggered again during the feature.

Panda Paradise operates in the same manner but with different symbols.

Jackpot Feature

Golden Peach & Pharaoh's Ransom

Progressives can be won in base games, wheel feature and feature game.

Electric Boogaloo & Panda Paradise

Progressives can be won in base games and wheel feature only.

An overlay is placed on the reels randomly at the start of each game. For each position, the odds of having and overlay=X bet multiplier in 15.

Jackpot conditions on a lit line a 5 of a kinds <PIC1>, <PIC2>, <PIC3>, <PIC4> or <PIC5> win with <QUICKFIRE> on a same lit line and no <WILD> substituting awards the GRAND progressive.

A 5 of a kinds <A>, <K>, <Q>, <J>, <10> or <9> win with <QUICKFIRE> on a same lit line and no <WILD> substituting awards the MAJOR progressive.

A 5 of a kinds <PIC1>, <PIC2>, <PIC3>, <PIC4> or <PIC5> win with <QUICKFIRE> on a same lit line and with <WILD> substituting awards the MINOR progressive.

A 5 of a kinds <A>, <K>, <Q>, <J>, <10> or <9> win with <QUICKFIRE> on a same lit line and with <WILD> substituting awards the MINI progressive.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic gaming machine comprising:

a display;

a memory storing program instructions for each of a plurality of different games; and a game controller executing the program instructions, which cause the game controller to at least:

determine a quantity of game instances to display on the display based on at least one player selection from among the different games, maintain at least one prize winnable from any one of the quantity of game instances during a play of a respective game instance, monitor plays of each of the quantity of game instances for at least one award condition to be met, and upon the at least one award condition being met in a respective play of at least one of the quantity of game instances and the quantity of game instances being greater than a designated quantity, determine a quantity of prizes to award.

2. The electronic gaming machine of claim 1, wherein the at least one prize comprises a first prize and a second prize.

3. The electronic gaming machine of claim 2, wherein when the quantity of prizes to award is at least two, a value of a first prize is a maintained value of the at least one prize and a value of a second prize is a reset value of the at least one prize.

4. The electronic gaming machine of claim 2, wherein when the quantity of prizes to award is at least two, a value of a first prize is a maintained value of a first of the at least one prize and a value of a second prize is a maintained value of a second of the at least one prize.

5. The electronic gaming machine of claim 1, wherein the program instructions further cause the game controller to provide a determined value of each of the quantity of prizes to at least one credit meter of the electronic gaming machine.

6. The electronic gaming machine of claim 1, wherein the program instructions further cause the game controller to, when the quantity of game instances is not greater than the designated quantity, upon the at least one award condition being met, award a value of a prize that corresponds to the at least one award condition.

7. The electronic gaming machine of claim 1, wherein the at least one prize comprises a plurality of prizes each having an associated award condition.

8. The electronic gaming machine of claim 1, wherein the at least one prize is a progressive prize.

9. The electronic gaming machine of claim 1, wherein the designated quantity is three game instances.

10. The electronic gaming machine of claim 1, wherein the game controller is configured to maintain the at least one prize via a server.

11. A method of operating an electronic gaming machine comprising a display device; a memory storing program instructions for each of a plurality of different games; and, a game controller configured to execute the program instructions, the method comprising:

determining, by the game controller, a quantity of game instances to display on the display device based on at least one player selection from among the different games;

maintaining, by the game controller, at least one prize winnable from any one of the quantity of game instances during a play of a respective game instance;

monitoring, by the game controller, plays of each of the quantity of game instances for at least one award condition to be met; and determining, by the game controller, a quantity of prizes to award when the at least one award condition is met in a respective play of at least one of the quantity of game instances and the quantity of game instances is greater than a designated quantity.

12. The method of claim 11, wherein the at least one prize comprises a first prize and a second prize.

13. The method of claim 12, wherein a value of a first prize is a maintained value of the at least one prize and a value of a second prize is a reset value of the at least one prize when the quantity of prizes to award is at least two.

14. The method of claim 12, wherein a value of a first prize is a maintained value of a first of the at least one prize and a value of a second prize is a maintained value of a second of the at least one prize when the quantity of prizes to award is at least two.

15. The method of claim 11, comprising providing, by the game controller, a determined value of each of the quantity of prizes to at least one credit meter of the electronic gaming machine.

16. The method of claim 11, comprising awarding, by the game controller, a value of a prize that corresponds to the at least one award condition when the quantity of game instances is not greater than the designated quantity and when the at least one award condition is met.

17. The method of claim 11, wherein the at least one prize comprises a plurality of prizes each having an associated award condition.

18. The method of claim 11, wherein the at least one prize is a progressive prize.

19. The method of claim 11, wherein the designated quantity is three game instances.

20. The method of claim 11, wherein the at least one prize is maintained by the game controller via a server.

* * * * *